US010631088B2

(12) United States Patent
Saha et al.

(10) Patent No.: US 10,631,088 B2
(45) **Date of Patent: *Apr. 21, 2020**

(54) PROCESSING OF SIGNALS FROM LUMINAIRE MOUNTED MICROPHONES FOR ENHANCING SENSOR CAPABILITIES

(71) Applicant: Current Lighting Solutions, LLC, East Cleveland, OH (US)

(72) Inventors: Koushik Babi Saha, Strongsville, OH (US); Thomas Clynne, East Cleveland, OH (US); Jonathan Robert Meyer, Shaker Heights, OH (US)

(73) Assignee: Current Lighting Solutions, LLC, East Cleveland, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/199,210

(22) Filed: Nov. 25, 2018

(65) Prior Publication Data

US 2019/0098401 A1 Mar. 28, 2019

Related U.S. Application Data

(63) Continuation of application No. 15/274,193, filed on Sep. 23, 2016, now Pat. No. 10,171,909.

(60) Provisional application No. 62/349,495, filed on Jun. 13, 2016.

(51) Int. Cl.

| | |
|---|---|
| ***H04R 3/00*** | (2006.01) |
| ***H04R 1/40*** | (2006.01) |
| *H04R 1/02* | (2006.01) |
| *G10L 21/0208* | (2013.01) |

(52) U.S. Cl.
CPC ..... *H04R 3/005* (2013.01); *H04R 1/406* (2013.01); *G10L 21/0208* (2013.01); *H04R 1/028* (2013.01); *H04R 2410/07* (2013.01); *H04R 2430/03* (2013.01)

(58) Field of Classification Search
CPC ..... G10L 21/0308; G10L 25/84; H04R 1/028
USPC ..... 704/273
See application file for complete search history.

(56) References Cited

U.S. PATENT DOCUMENTS

2011/0026722 A1* 2/2011 Jing ..... G10L 21/0208 381/71.1
2014/0333206 A1* 11/2014 Simons ..... H05B 47/105 315/132
2016/0286627 A1* 9/2016 Chen ..... H05B 47/19

* cited by examiner

*Primary Examiner* — Bharatkumar S Shah
(74) *Attorney, Agent, or Firm* — Buckley, Maschoff & Talwalkar LLC

(57) ABSTRACT

The specification and drawings present a use of multiple microphones for increasing acoustic sensing capabilities by processing acoustic signals from the multiple microphones in outdoor luminaire mounted surveillance/sensor systems. For example, various embodiments presented herein describe signal processing means to utilize stereo/multiple microphones in a luminaire (such as an outdoor roadway luminaire) to provide enhanced information regarding the surroundings of the luminaire. The multiple microphone luminaire sensor processing system can provide a more environmentally robust and sensitive approach which can be, for example, resistant to environmental noise such as a wind noise, as well as capable of isolating specific sounds from the surroundings, e.g., in specific directions.

20 Claims, 6 Drawing Sheets

PROCESSING OF SIGNALS FROM LUMINAIRE MOUNTED MICROPHONES FOR ENHANCING SENSOR CAPABILITIES

CROSS-REFERENCE

The present application claims priority from prior-filing, commonly-owned provisional U.S. patent application Ser. No. 62/349,495, filed 13 Jun. 2016.

TECHNICAL FIELD

The present invention generally relates to luminaires. More particularly but not exclusively, this invention relates to increasing acoustic sensing capabilities by processing acoustic signals from multiple microphones in outdoor luminaire mounted surveillance systems.

BACKGROUND OF THE INVENTION

Outdoor luminaires have begun to be pressed into service as power and mounting platforms for a variety of electronic sensor and data processing systems. The sensors used in these systems can be one or more from a wide variety including, but not limited to, cameras, microphones, environmental gas sensors, accelerometers, gyroscopes, antennas, and many others.

It may be advantageous to utilize the aerial mounted position of a luminaire (e.g., roadway luminaire) as a platform for positioning and powering sensor and processing systems. As a part of doing this, the collection of acoustic signals via the use of one or more microphones as key sensors can be employed in such systems.

SUMMARY OF THE INVENTION

According to a first aspect of the invention, a method for using a plurality of microphones in a sensor module of a luminaire (e.g., the microphones being spatially separated and having different detection directionalities), the method comprising: receiving, by a computing module of the sensor module, information comprising a plurality of acoustic output signals from the corresponding plurality of microphones, and any of detection directionality and location for each of the plurality of microphones; processing (e.g., in time and/or frequency domain), by the computing module, using the received information, the plurality of acoustic output signals to: identify a desirable acoustic signal at least in one of the plurality of acoustic output signals using analysis of the received plurality of acoustic output signals, and correlate the acoustic output signals with any of the detection directionalities and locations of the plurality microphones.

According further to the first aspect of the invention, the method may further comprise: receiving (wirelessly or through a wired connection) by the sensor module one or more further acoustic signals from corresponding one or more further microphones outside of the luminaire with information about further microphones' detection directionalities and locations; and further processing, by the computing module, the plurality of acoustic output signals with added one or more further acoustic signals for the identification and correlation.

According to a second aspect of the invention, a luminaire comprising a sensor module which comprises: a plurality of microphones (e.g., being spatially separated and having different detection directionalities); a processor; and a memory for storing program logic, the program logic executed by the processor, the program logic comprising: logic for receiving information comprising a plurality of acoustic output signals from the corresponding plurality of microphones, and any of detection directionality and location for each of the plurality of microphones; and logic for processing (e.g., in time and/or frequency domain), using the received information, the plurality of acoustic output signals to: identify a desirable acoustic signal at least in one of the plurality of acoustic output signals using analysis of the received plurality of acoustic output signals, and correlate the acoustic output signals with any of the detection directionalities and locations of the plurality microphones.

According further to the second aspect of the invention, the program logic may further comprise: logic for receiving (wirelessly or through a wired connection) by the sensor module one or more further acoustic signals from corresponding one or more further microphones outside of the luminaire with information about further microphones' detection directionalities and locations; and logic for further processing, by the computing module, the plurality of acoustic output signals with added one or more further acoustic signals for the identification and correlation.

BRIEF DESCRIPTION OF THE DRAWINGS

These and other features and aspects of the present disclosure will become better understood when the following detailed description is read, with reference to the accompanying drawings, in which like characters represent like parts throughout the drawings, wherein.

DETAILED DESCRIPTION

Figure 1A:
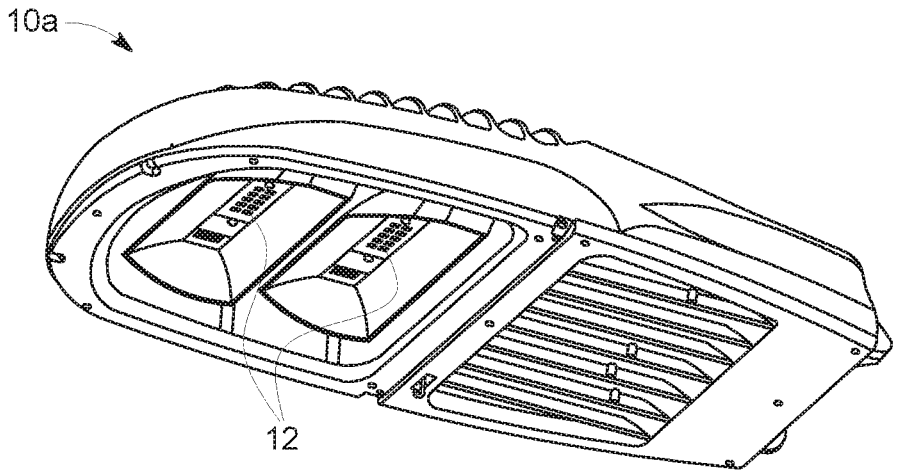
FIGS. 1A-1B are three-dimensional views of an original luminaire unit (FIG. 1A) with LED modules, and of a modified luminaire unit (FIG. 1B) which further include a sensor module (surveillance unit) which can be attachable to and detachable from the original luminaire unit of FIG. 1A, according to an embodiment of the invention.

Use of multiple (e.g., two or more) microphones is presented for increasing acoustic sensing capabilities by processing acoustic signals from the multiple microphones in outdoor luminaire mounted surveillance/sensor systems. For example, various embodiments presented herein describe signal processing means to utilize stereo/multiple microphones in a luminaire (such as an outdoor roadway luminaire) to provide enhanced information regarding the surroundings of the luminaire. The multiple microphone luminaire sensor processing system can provide a more environmentally robust and sensitive approach which can be, for example, resistant to environmental noise such as a wind noise, as well as capable of isolating specific sounds from the surroundings, e.g., in specific directions.

According to an embodiment of the invention, data and signal analysis can be done on the output signals from the microphones, so that having multiple acoustic signals from the surroundings can provide additional features that might otherwise be unavailable from a single, monaural signal. Additional information may be acquired, e.g., by correlation of the direction of the detected sound based upon a knowledge of detection (sensor) directionality of the microphone. Frequently, the use of cameras and other sensory devices may be utilized as part of roadway luminaire mounted sensor and processing systems, and they (cameras and sensory devices) are generally pointed in a specific direction to provide information about an area surrounding the luminaire. Correlation of a directional microphone with a specific camera which is pointing in the same direction can provide additional information for the users of the system. A video cue can create a demand for processing of the correlated audio signal, and vice versa, the audio cue from a specific microphone can instigate a demand for a specific algorithm to be applied to a video stream's analytics.

According to a further exemplary embodiment, use of dual microphones that are spatially separated (i.e., being at different locations) and directionally different can provide two different audio signals of the surroundings of the sensor system. The two audio streams may have slight differences between them (e.g., different sound features but similar noise pattern) due to the virtue of the microphone directional and/or location aspects based on how the sounds were picked up by the two microphones. In this case, it is possible for the audio streams to be subtracted from each other in order to better isolate a specific desired sound. For example, if a person is below and off to one side of the sensor system, the intensity of the sounds generated by the person will be higher in the microphone which is preferentially pointing toward that person. Mixed in with the audio signal will be the sounds of the surroundings, in this case, vehicle noise and the general background sounds, and these background sounds will be also detected by the microphone which is pointing away from the person. It is possible to subtract the non-preferential signal from the preferential one and provide higher isolation of the sounds the person is generating, by using known audio subtraction and isolation techniques.

According to a further embodiment, using a multiple microphone approach can help to solve a wind noise problem which can be encountered in a luminaire mounted sensor system that includes the microphones. Due to its location outdoors, the system can be a subject to winds impinging upon it. The impingement of wind on the system can create turbulence as the air flows around the system, which manifests itself as variations in the pressure waves acting upon the microphones, and can be interpreted as a false environmental noise. This wind noise associated with higher speed wind can easily be of a higher magnitude than the surrounding sounds of interest, which can render the audio input useless. This wind noise often is directional in nature, driven by the interaction of the system in the wind column and how the air flow around the system is shed and creates vortices and turbulence. As stated, if this turbulence falls upon a microphone, it can create noise in excess of the surrounding sounds to be detected and render the system useless. Having two (or more) microphones in the system (e.g., microphones having different locations and detection directivity) can provide alternate opportunities for two similar signals to be sampled and potentially provide a less noisy signal if one of the microphones is not in the turbulent air column.

Moreover, it should be noted that the inclusion of more than two microphones in the system, together with the ability to preferentially point them in unique directions, can serve to provide additional aspects of the aforementioned capabilities, and may serve to further increase the directional fidelity and/or signal isolation capabilities of the system. The addition of multiple microphones in the system may also provide a capability to utilize classical beam forming techniques in order to further isolate sounds from the environment, as further described herein.

According to another embodiment, it may be possible that output acoustic signals from microphones not mounted on the luminaire can be used for inclusion with the data streams from sensors (e.g., microphones, cameras, etc.) mounted on the luminaire.

Thus, according to an embodiment of the invention, a method, for using a plurality of microphones in a sensor (surveillance) module of a luminaire, may comprise: receiving, by a computing module (comprising at least one processor and a memory) of the sensor module, information comprising a plurality of acoustic output signals from the corresponding plurality of microphones, and any of detection directionality and location for each of the plurality of microphones. This receiving can be followed by processing, using the computing module and based on the received information, the plurality of acoustic output signals in order to identify a desirable acoustic signal at least in one of the plurality of acoustic output signals using analysis of the received plurality of acoustic output signals, and/or to correlate the acoustic output signals with any of the detection (sensor) directionalities and/or locations of the plurality microphones. The processing can be performed in a time domain and/or in a frequency domain using, e.g., a fast Fourier transform. The microphones may be spatially separated and/or may have different detection/sensor directionalities.

According to a further exemplary embodiment, the processing (before identifying and correlating) may further comprise selecting acoustic output signals from the plurality of acoustic output signals which are above a noise floor level; this noise floor level may be predefined/measured and stored (e.g., in a memory of the sensor module) for each of the plurality of microphones in advance.

According to another exemplary embodiment, when at least two of selected acoustic output signals have different sound features, the correlation may comprise associating each of the acoustic signals having different sound features, with a corresponding further signal from a further sensor (e.g., video signal from a video camera) having the same directionality as the corresponding detection directionality of the corresponding microphone.

Moreover, according to a further exemplary embodiment, when at least two of selected acoustic output signals have similar sound features but different noise levels, the identifying may comprise choosing one of the selected acoustic signal with a minimum noise level.

Furthermore, according to yet another exemplary embodiment, when the selected acoustic output signals have insignificant sound feature differences, e.g., in a predefined range, and have a similar noise level, a subtraction technique between the corresponding selected acoustic output signals may be used to better isolate a specific sound feature of interest.

According to an embodiment of the invention, the sensor module of the luminaire may receive (wirelessly or through a wired connection) one or more further acoustic signals from corresponding one or more further microphones outside of the luminaire with information about further microphones' detection directionalities and/or locations. This can be followed by a further processing of the plurality of acoustic output signals with added one or more further acoustic signals for the identification and correlation, according to various embodiments of the invention.

It is further noted that the embodiments described herein may apply to various types of microphones having various features and properties. Better quality microphones and their packaging in the luminaire may provide more accurate results attained using described embodiments. Then for use with an outdoor luminaire to practice these embodiments, the following characteristics (at least in part) may be desirable:

- waterproof—the microphone must be waterproof so as to avoid electrical shorting and/or signal attenuation from changing the mass of the microphone active structure via the collection of water;
- dynamic range and sensitivity—the microphone, by virtue of its requirement to pick up a wide range of sounds, must be mounted and protected in a way so that the incoming sounds are not attenuated by the components and materials chosen to protect it; further, the mounting system should not alter the frequency/amplitude makeup of the acoustic signals being detected;
- impact noise resistance—an outdoor luminaire mounted microphone has to be resistant to conducted impact noises such as that encountered by rain, sleet and hail which can obscure the sounds of interest and potentially cause false alarms to be reported to the signal analysis software;
- wind noise resistance—the microphone must be mounted in a manner so that it does not impede the flow of wind around the housing, lest it generate its own noise component from pressure buffeting, thereby masking the incoming sounds which it is intended to detect;
- unobtrusiveness—it is advantageous to make the microphone unobtrusive to passers-by, so that they are less likely to observe that their sounds are being detected; and
- environmental resistance—any materials used and exposed to rain and direct sunlight be able to withstand the degrading effects of weathering and UV (ultraviolet) sunlight exposure.

Figures presented below provide non-limiting examples for practicing some embodiments of the invention. It is noted that identical or similar parts/elements are designated using the same reference numbers in different figures.

Figure 1B:
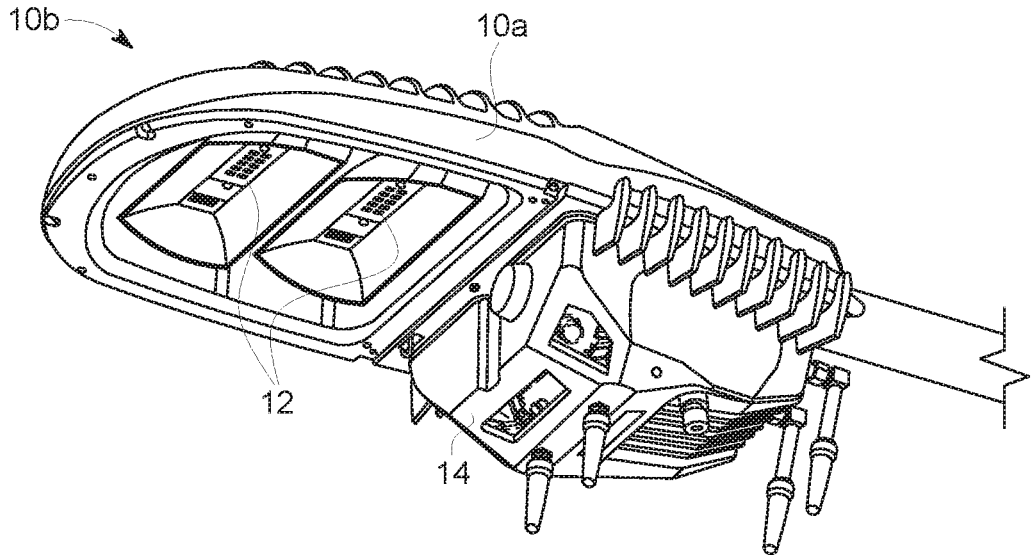

FIGS. 1A-1B are three-dimensional views of an original luminaire unit 10*a* (FIG. 1A) with LED modules 12, and a modified luminaire unit 10*b* (FIG. 1B) which further includes a sensor module (surveillance unit) 14 which can be attachable to and detachable from the original luminaire unit 10*a* and can be used for practicing various embodiments of the invention.

Figure 2A:
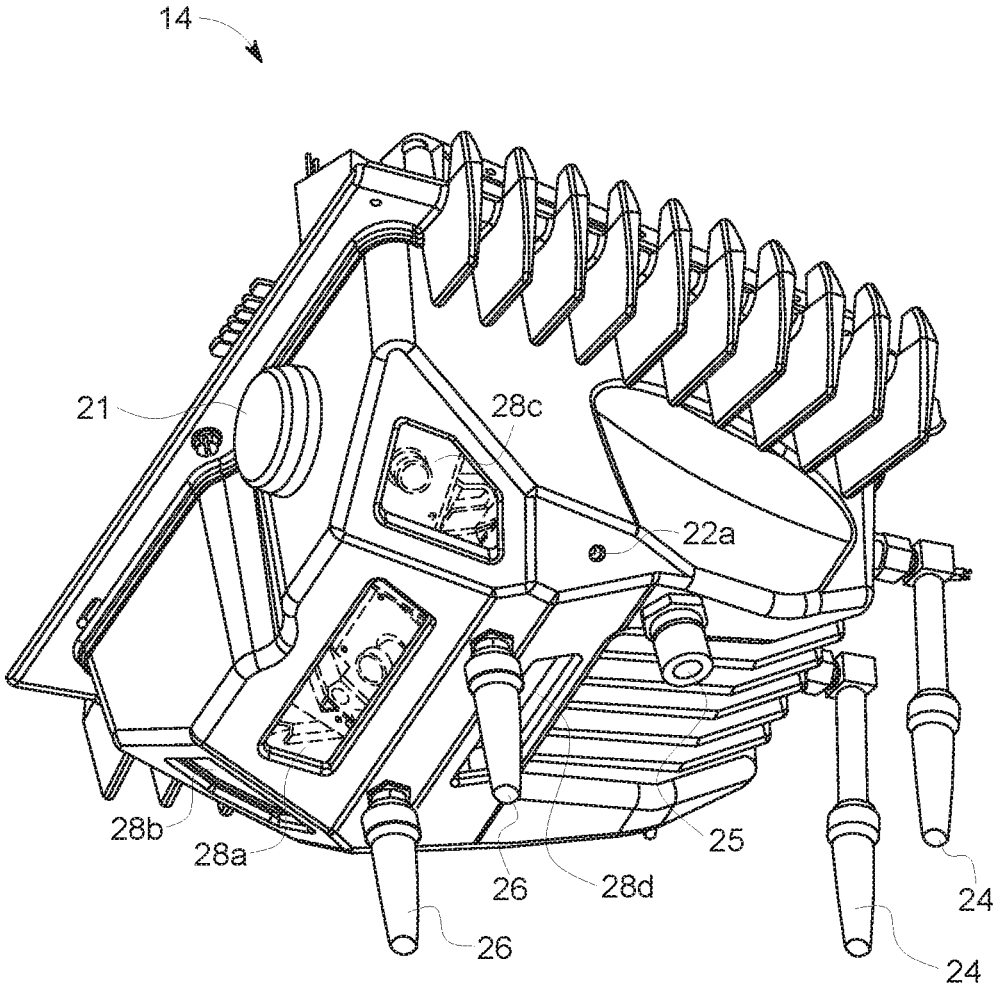
FIGS. 2A-2B are a three-dimensional view (FIG. 2A) and a two-dimensional bottom view (FIG. 2B) of a sensor module, according to an embodiment of the invention.
Figure 2B:
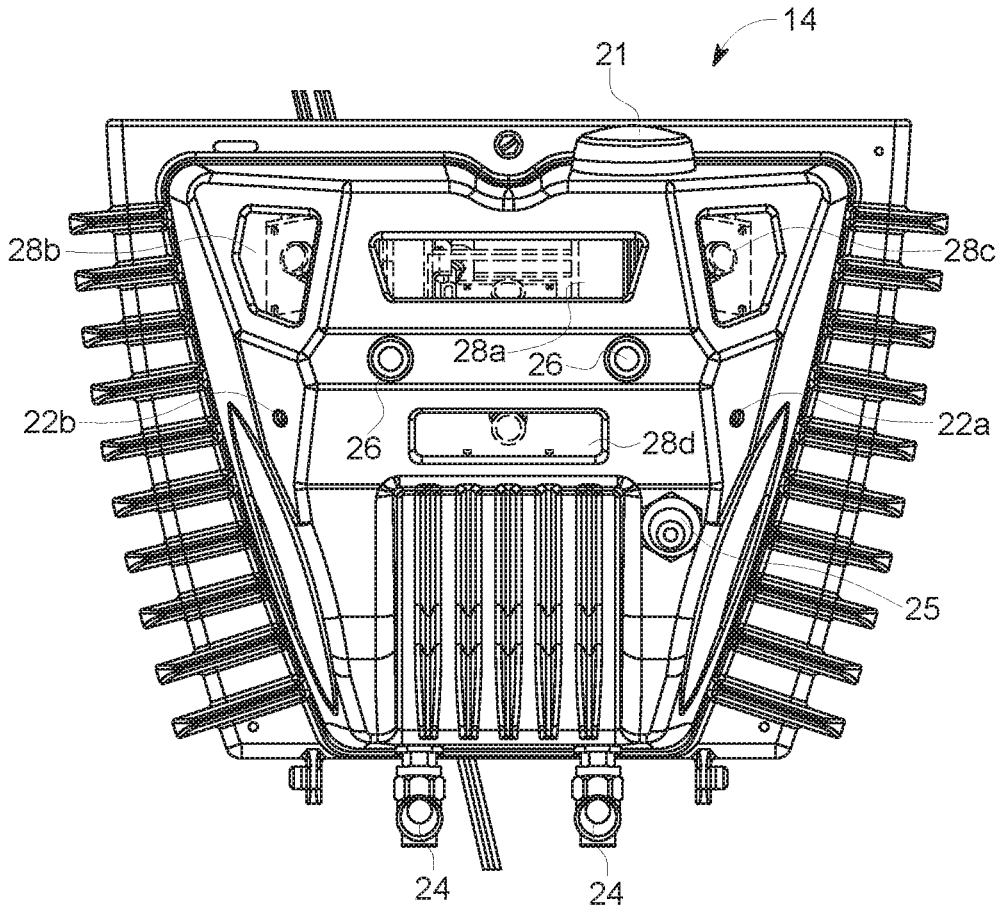

FIGS. 2A-2B show a three-dimensional view (FIG. 2A) and a two-dimensional bottom view (FIG. 2B) of a sensor module 14, according to an embodiment of the invention. The module 14 comprises multiple sensors including microphones 22*a* and 22*b*. Other sensors may also include multiple cameras 28*a*-28*d*, an environmental sensor 25, a GPS antenna 21, Wi-Fi antennas 24 and cell modem antennas 26. It is noted that detection directionality of the microphones 22*a* and 22*b* are substantially the same as directionality of corresponding cameras 28*c* and 28*b*, so that sound signals from microphones 22*a* and 22*b* may be complimentary to the video signals from the corresponding cameras 28*c* and 28*b*, according to one of the embodiments described herein.

Figure 3:
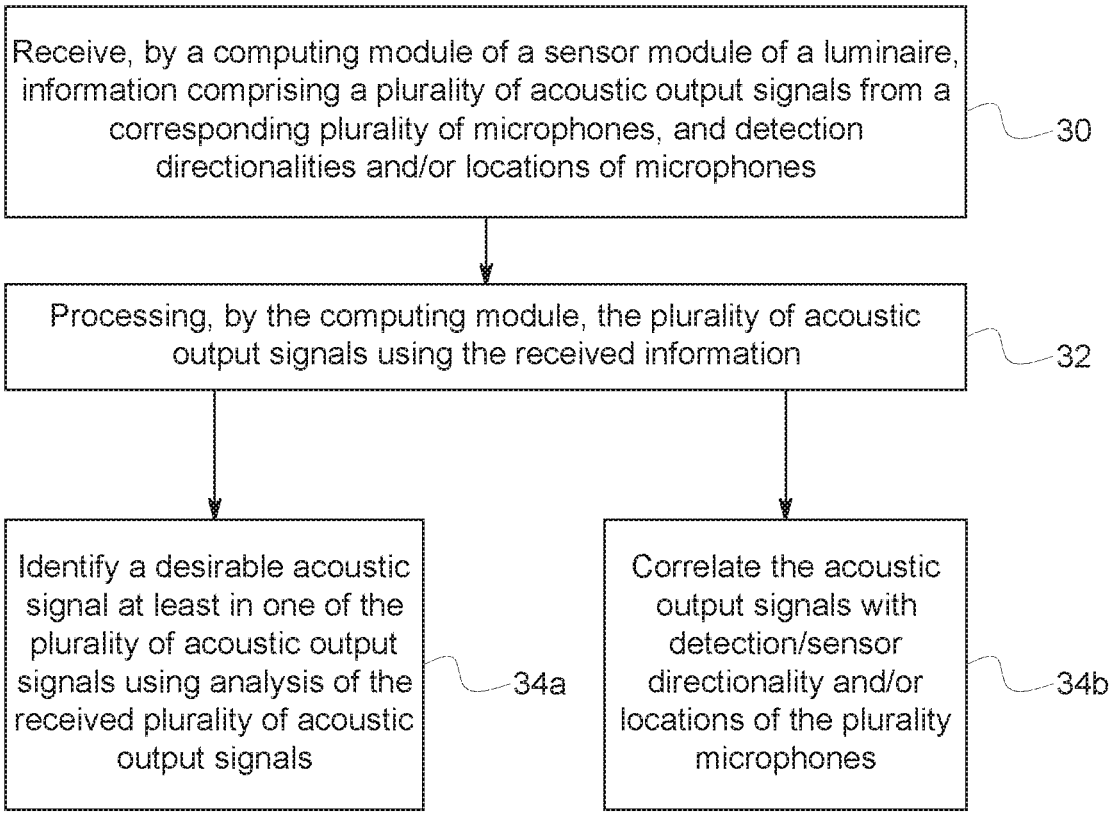
FIG. 3 is a generalized flowchart summarizing implementation of various embodiments described herein.

FIG. 3 is a generalized flowchart summarizing implementation of embodiments disclosed herein. It is noted that the order of steps shown in FIG. 3 is not required, so in principle, the various steps may be performed out of the illustrated order. Also certain steps may be skipped, different steps may be added or substituted, or selected steps or groups of steps may be performed in a separate application, following the embodiments described herein.

In a method according to this exemplary embodiment, as shown in FIG. 3, in a first step 30, a computing module (comprising at least one processor and a memory) of a sensor module of a luminaire receives information comprising a plurality of acoustic output signals from a corresponding plurality of microphones, and detection directionalities and/or locations of microphones. In a next step 32, the computing module processes the plurality of acoustic output signals using the received information, wherein step 32*a* corresponds to identifying a desirable acoustic signal at least in one of the plurality of acoustic output signals using analysis of the received plurality of acoustic output signals, and step 32*b* corresponds to correlating the acoustic output signals with detection/sensor directionality and/or locations of the plurality microphones.

Figure 4:
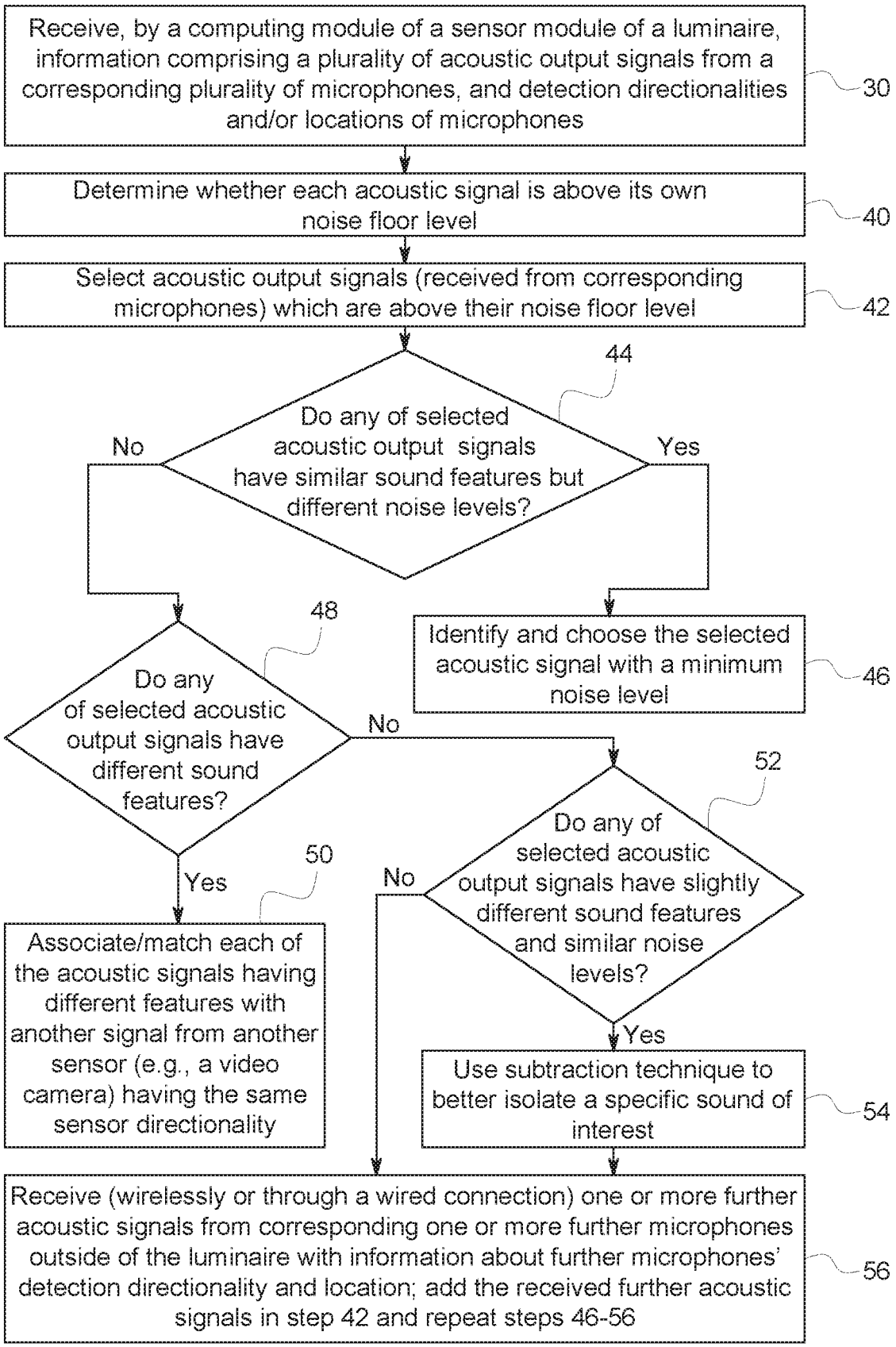
FIG. 4 is an exemplary detailed flowchart for implementation of some embodiments, which are disclosed herein and generalized in FIG. 3.

FIG. 4 is an exemplary detailed flowchart for implementation of embodiments, which are disclosed herein and generalized in FIG. 3. It is noted that the order of steps shown in FIG. 4 is not required, so in principle, the various steps may be performed out of the illustrated order. Also certain steps may be skipped, different steps may be added or substituted, or selected steps or groups of steps may be performed in a separate application, following the embodiments described herein.

In a method according to this exemplary embodiment, as shown in FIG. 4, in a first step 30 (which is the same step as in FIG. 3), a computing module (comprising at least one processor and a memory) of a sensor module of a luminaire receives information comprising a plurality of acoustic output signals from a corresponding plurality of microphones, and detection directionalities and/or locations of microphones. In a next step 40, the computing module determines whether each received acoustic signal is above its own noise floor level. For example, the noise floor level can be measured for each microphone for a "quiet condition" and stored in the memory. Then in a next step 42, based on the determination in step 40, the computing module selects acoustic output signals (received from corresponding microphones) which are above their noise floor levels.

In a next step 44, the computing module determines whether all or at least two of selected acoustic output signals have similar sound features but different noise levels. If it is determined in step 44 that this is the case, in a next step 46, the computing module identifies and chooses the selected acoustic signal with a minimum noise level to represent the desired sound signal. After step 46, the process may go optionally to step 48 or step 52 described below (not shown in FIG. 4).

However, if it is determined in step 44 that none of the selected acoustic output signals have similar sound features but different noise levels, in a next step 48, the computing module further determines whether the selected acoustic output signals have different sound features. If it is determined in step 48 that this is the case, in a next step 50, the computing module associates/matches each of the acoustic signals having different features with another signal from another sensor (e.g., a video camera) having the same sensor directionality as the detection directivity of the corresponding microphone. After step 50, the process may go optionally to step 52 described below (not shown in FIG. 4).

However, if it is determined in step 48 that that none of the selected acoustic output signals have different sound features, in a next step 52, the computing module further determines whether any of the selected acoustic output signals have slightly different sound features (e.g., the difference being in a predefined range) and similar/identical noise levels. If it is determined in step 52 that this is the case, in a next step 54, the computing module can use a subtraction technique to better isolate a specific signal/sound feature of interest.

However, if it is determined in step 52 that none of the selected acoustic output signals have the slightly different sound features (e.g., the difference being in a predefined range) and similar/identical noise levels, the process can go to step 56. In step 56, the computing module of the luminaire can receive (wirelessly or through a wired connection) one or more further acoustic signals from corresponding one or more further microphones outside of the luminaire with information about further microphones' detection directionalities and locations, so that the one or more further acoustic signals are added in step 42, followed by repeating steps 46-56.

Figure 5:
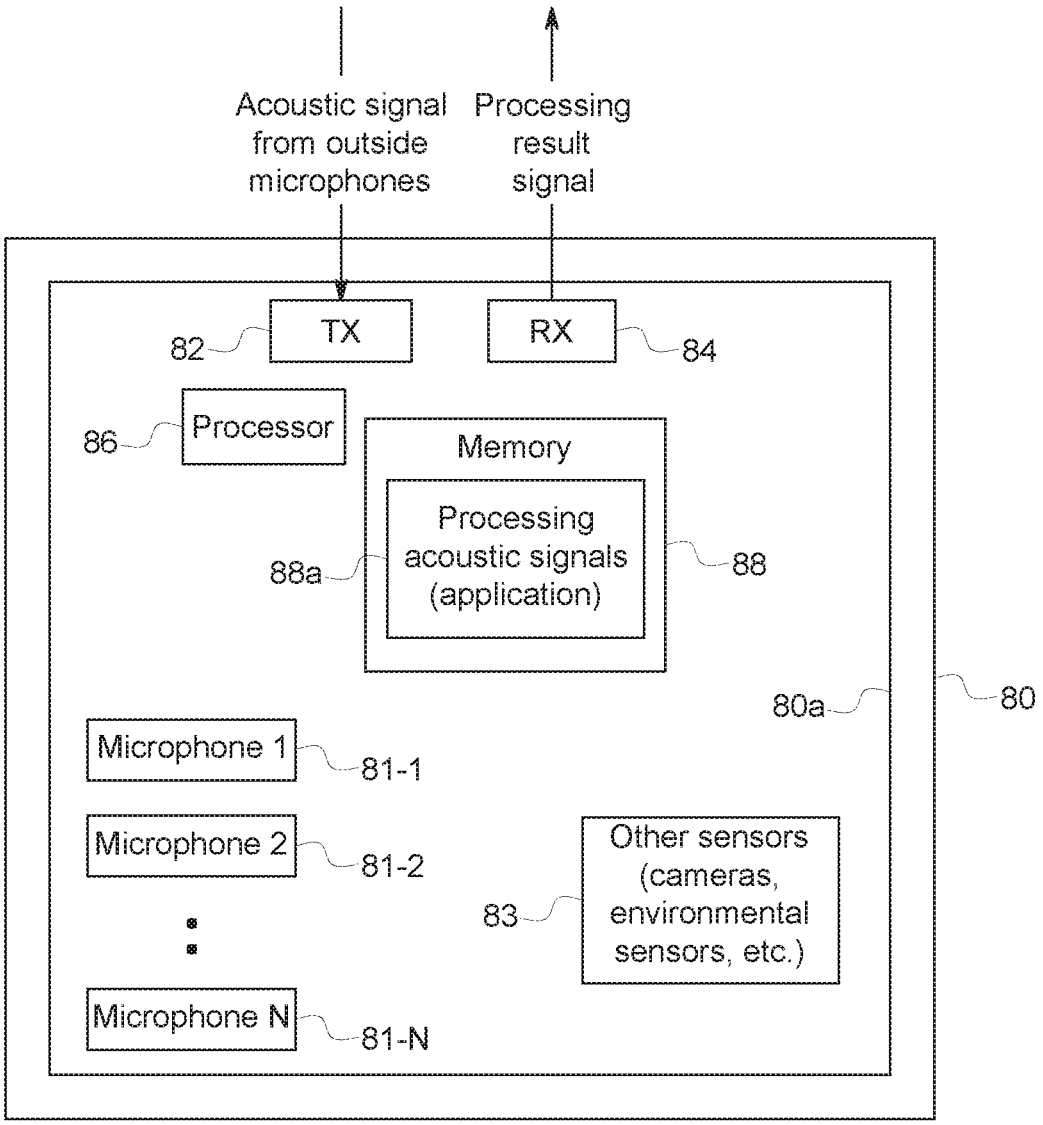
FIG. 5 is an exemplary block diagram of a luminaire comprising a sensor module/device, which can be used for implementing various embodiments of the invention.

FIG. 5 shows an example of a block diagram of a luminaire 80 comprising a sensor module/device 80*a*, which can be used to implement various embodiments of the invention described herein. FIG. 5 is a simplified block diagram of the device 80 that is suitable for practicing the exemplary embodiments of this invention, e.g., in reference to FIGS. 3-4, and a specific manner in which components of the sensor module/device 80*a* are configured to cause that module/device to operate.

The module 80 may comprise, e.g., at least one transmitter 82, at least one receiver 84, at least one processor (controller) 86, and at least one memory 88 including a processing acoustic signals application 88*a*. The transmitter 82 and the receiver 82 may be configured to transmit and receive signals (wirelessly or using a wired connection). The received signals may comprise acoustic signals from outside microphones and related information, as described herein. The transmitted signals may comprise generated processing results using acoustic output signals from multiple microphones 81-1, 81-2, . . . , 81-N(N being a finite integral). The transmitter 82 and the receiver 84 may be generally means for transmitting/receiving and may be implemented as a transceiver (e.g., a wireless transceiver), or a structural equivalent thereof. Other sensors 83 may comprise a variety of different sensors such as cameras, environmental sensors and the like.

Various embodiments of the at least one memory 88 (e.g., computer readable memory) may include any data storage technology type which is suitable to the local technical environment, including but not limited to: semiconductor based memory devices, magnetic memory devices and systems, optical memory devices and systems, fixed memory, removable memory, disc memory, flash memory, DRAM, SRAM, EEPROM and the like. Various embodiments of the processor 86 may include but are not limited to: general purpose computers, special purpose computers, microprocessors, digital signal processors (DSPs), multi-core processors, embedded, and System on Chip (SoC) devices.

The processing acoustic signals application 88*a* may provide various instructions for performing, for example, steps 30, 32, 32*a*, and 32*b* shown in FIG. 3 and further steps 40-56 in FIG. 4. The module 88*a* may be implemented as an application computer program stored in the memory 88, but in general it may be implemented as software, firmware and/or a hardware module, or a combination thereof. In particular, in the case of software or firmware, one embodiment may be implemented using a software related product such as a computer readable memory (e.g., non-transitory computer readable memory), computer readable medium or a computer readable storage structure comprising computer readable instructions (e.g., program instructions) using a computer program code (i.e., the software or firmware) thereon to be executed by a computer processor.

Unless defined otherwise, technical and scientific terms used herein have the same meaning as is commonly understood by one having ordinary skill in the art to which this disclosure belongs. The terms "first", "second", and the like, as used herein, do not denote any order, quantity, or importance, but rather are employed to distinguish one element from another. Also, the terms "a" and "an" do not denote a limitation of quantity, but rather denote the presence of at least one of the referenced items. The use of "including," "comprising" or "having" and variations thereof herein are meant to encompass the items listed thereafter and equivalents thereof, as well as additional items. The terms "connected" and "coupled" are not restricted to physical or mechanical connections or couplings, and can include electrical and optical connections or couplings, whether direct or indirect.

Furthermore, the skilled artisan will recognize the interchangeability of various features from different embodiments. The various features described, as well as other known equivalents for each feature, can be mixed and matched by one of ordinary skill in this art, to construct additional systems and techniques in accordance with principles of this disclosure.

In describing alternate embodiments of the apparatus claimed, specific terminology is employed for the sake of clarity. The invention, however, is not intended to be limited to the specific terminology so selected. Thus, it is to be understood that each specific element includes all technical equivalents that operate in a similar manner to accomplish similar functions.

It is to be understood that the foregoing description is intended to illustrate and not to limit the scope of the invention, which is defined by the scope of the appended claims. Other embodiments are within the scope of the following claims.

It is noted that various non-limiting embodiments described and claimed herein may be used separately, combined or selectively combined for specific applications.

Further, some of the various features of the above non-limiting embodiments may be used to advantage, without the corresponding use of other described features. The foregoing description should therefore be considered as merely illustrative of the principles, teachings and exemplary embodiments of this invention, and not in limitation thereof.

What is claimed is:

1. A method for using a plurality of microphones in a sensor module of a luminaire, the method comprising: receiving, by a computing module of the sensor module, information comprising a plurality of acoustic output signals from the corresponding plurality of microphones, and any of detection directionality and location for each of the plurality of microphones; processing, by the computing module, using the received information, the plurality of acoustic output signals to: identify a desirable acoustic signal at least in one of the plurality of acoustic output signals using analysis of the received plurality of acoustic output signals, and correlate the acoustic output signals with any of the detection directionalities and locations of the plurality microphones.

2. The method of claim 1, wherein the processing is performed in a frequency domain using a fast Fourier transform.

3. The method of claim 1, wherein the processing is performed in a time domain.

4. The method of claim 1, wherein the processing, before said identifying and correlating, further comprises selecting acoustic output signals from the plurality of acoustic output signals which are above a noise floor level predefined and stored for each of the plurality of microphones.

5. The method of claim 1, wherein, when at least two of selected acoustic output signals have different sound features, said correlation comprises associating each of the acoustic signals having different sound features, with a corresponding further signal from a further sensor of the luminaire having a same directionality as the corresponding detection directionality of the corresponding microphone.

6. The method of claim 5, wherein the further sensor is a video camera, and the corresponding further signal is a video signal.

7. The method of claim 1, wherein, when at least two of selected acoustic output signals have similar sound features but different noise levels, said identifying comprises choosing one of the selected acoustic signal with a minimum noise level.

8. The method of claim 1, wherein the selected acoustic output signals have sound feature differences in a predefined range and have a similar noise level, a subtraction technique between the corresponding selected acoustic output signals is used to better isolate a specific sound of interest.

9. The method of claim 1, further comprising: receive, wirelessly or through a wired connection, by the sensor module one or more further acoustic signals from corresponding one or more further microphones outside of the luminaire with information about further microphones' detection directionalities and locations; and further processing, by the computing module, the plurality of acoustic output signals with added one or more further acoustic signals for said identification and correlation.

10. The method of claim 1, wherein the plurality of microphones are spatially separated and have different detection directionalities.

11. A luminaire comprising a sensor module which comprises: a plurality of microphones; a processor and a memory for storing program logic, the program logic executed by the processor, comprising: logic for receiving information comprising a plurality of acoustic output signals from the corresponding plurality of microphones, and any of detection directionality and location for each of the plurality of microphones; and logic for processing, using the received information, the plurality of acoustic output signals to: identify a desirable acoustic signal at least in one of the plurality of acoustic output signals using analysis of the received plurality of acoustic output signals, and correlate the acoustic output signals with any of the detection directionalities and locations of the plurality microphones.

12. The luminaire of claim 11, wherein the processing is performed in a frequency domain using a fast Fourier transform.

13. The luminaire of claim 11, wherein the processing is performed in a time domain.

14. The luminaire of claim 11, wherein the processing, before said identifying and correlating, further comprises selecting acoustic output signals from the plurality of acoustic output signals which are above a noise floor level predefined and stored for each of the plurality of microphones.

15. The luminaire of claim 11, wherein, when at least two of selected acoustic output signals have different sound features, said correlation comprises associating each of the acoustic signals having different sound features, with a corresponding further signal from a further sensor of the luminaire having a same directionality as the corresponding detection directionality of the corresponding microphone.

16. The luminaire of claim 15, wherein the further sensor is a video camera, and the corresponding further signal is a video signal.

17. The luminaire of claim 11, wherein, when at least two of selected acoustic output signals have similar sound features but different noise levels, said identifying comprises choosing one of the selected acoustic signal with a minimum noise level.

18. The luminaire of claim 11, wherein the selected acoustic output signals have sound feature differences in a predefined range and have a similar noise level, a subtraction technique between the corresponding selected acoustic output signals is used to better isolate a specific sound of interest.

19. The luminaire of claim 11, wherein the program logic further comprises: logic for receiving, wirelessly or through a wired connection, by the sensor module one or more further acoustic signals from corresponding one or more further microphones outside of the luminaire with information about further microphones' detection directionalities and locations; and logic for further processing, by the computing module, the plurality of acoustic output signals with added one or more further acoustic signals for said identification and correlation.

20. The luminaire of claim 11, wherein the plurality of microphones are spatially separated and have different detection directionalities.

* * * * *